US012768366B2

(12) United States Patent
Ohno et al.

(10) Patent No.: US 12,768,366 B2
(45) Date of Patent: Oct. 20, 2026

(54) IMPELLER AND CENTRIFUGAL FAN

(71) Applicant: MINEBEA MITSUMI Inc., Nagano (JP)

(72) Inventors: Yuuma Ohno, Kitasaku-gun (JP); Haruomi Morohashi, Kitasaku-gun (JP); Daiki Hayashi, Kitasaku-gun (JP)

(73) Assignee: MINEBEA MITSUMI INC., Nagano (JP)

( * ) Notice: Subject to any disclaimer, the term of this patent is extended or adjusted under 35 U.S.C. 154(b) by 161 days.

(21) Appl. No.: 18/869,690

(22) PCT Filed: Apr. 11, 2023

(86) PCT No.: PCT/JP2023/014724
§ 371 (c)(1),
(2) Date: Nov. 26, 2024

(87) PCT Pub. No.: WO2023/228608
PCT Pub. Date: Nov. 30, 2023

(65) Prior Publication Data

US 2026/0243270 A1 Aug. 20, 2026

(30) Foreign Application Priority Data

May 27, 2022 (JP) ..... 2022-086736

(51) Int. Cl.
*F04D 29/28* (2006.01)
*F04D 17/16* (2006.01)
*F04D 25/08* (2006.01)

(52) U.S. Cl.
CPC ..... *F04D 29/281* (2013.01); *F04D 17/16* (2013.01); *F04D 25/08* (2013.01)

(58) Field of Classification Search
None
See application file for complete search history.

(56) References Cited

U.S. PATENT DOCUMENTS 10,428,827 B2 * 10/2019 Yamada ..... F04D 25/0613
11,578,605 B2 * 2/2023 Park ..... F01D 5/3007
(Continued)

FOREIGN PATENT DOCUMENTS

JP S53-54301 A 5/1978
JP 2009257132 A 11/2009
(Continued)

OTHER PUBLICATIONS

International Search Report for corresponding International Application No. PCT/JP2023/014724 mailed Jun. 27, 2023.
(Continued)

*Primary Examiner* — Courtney D Heinle
*Assistant Examiner* — Danielle M. Christensen
(74) *Attorney, Agent, or Firm* — Chrisman Gallo Tochtrop LLC

(57) ABSTRACT

The impeller includes a main plate having an annular shape, a shroud spaced apart from the main plate in an axial direction and having an annular shape, and a plurality of blades disposed in series in a circumferential direction between the main plate and the shroud. The blades are formed integral with the shroud and include ribs protruding in the axial direction on end surfaces of the blades in the axial direction. The main plate includes grooves to be fitted with the ribs. The shroud includes a recessed part. One set of a rib and a groove of the ribs and the grooves can be fitted each other. The one set of the rib and the groove and combinations of the ribs and the grooves other than the one set of the rib and the groove cannot be fitted each other.

12 Claims, 6 Drawing Sheets

(56) References Cited

U.S. PATENT DOCUMENTS

| | | | | |
|---|---|---|---|---|
| 12,140,150 | B2 * | 11/2024 | Seok | F04D 1/00 |
| 2013/0084173 | A1 | 4/2013 | Fukuda et al. | |

FOREIGN PATENT DOCUMENTS

| | | | |
|---|---|---|---|
| JP | 2010065528 | A | 3/2010 |
| JP | 2013-076335 | A | 4/2013 |
| JP | 2015-040539 | A | 3/2015 |
| JP | 2018115646 | A | 7/2018 |
| JP | 2019-203473 | A | 11/2019 |

OTHER PUBLICATIONS

Written Opinion for corresponding International Application No. PCT/JP2023/014724 dated Jun. 27, 2023.
Second Office Action in the corresponding JP application No. 2022-086736 Jun. 25, 2026.
English Translation of Written Opinion of Application PCT/JP2023/014724 Jun. 27, 2023.

* cited by examiner

IMPELLER AND CENTRIFUGAL FAN

CROSS REFERENCE TO RELATED APPLICATIONS

This application is a continuation of International Application No. PCT/JP2023/014724, filed on Apr. 11, 2023, which claims priority to Japanese Patent Application 2022-086736, filed on May 27, 2022, which is incorporated herein by reference.

TECHNICAL FIELD

The disclosure relates to an impeller and a centrifugal fan using the impeller.

BACKGROUND

A centrifugal fan is known as a blower widely used for cooling, ventilation, and air-conditioning in household electrical appliances, office automation equipment and industrial equipment, air-conditioning and air-blowing in vehicular equipment, and the like. As this type of a centrifugal fan, a known centrifugal fan includes a case consisting of an upper casing and a lower casing, an impeller and a motor housed inside the casing. The impeller is rotated by driving of the motor, and with the rotation of the impeller, air sucked from a suction port is blown off toward the outside of the casing from a blow-off port formed over the entire circumference of a side surface between the upper casing and the lower casing (see, for example, JP 2019-203473 A).

In the centrifugal fan of JP 2019-203473 A, a centrifugal fan 100 includes a casing 103 composed of an upper casing 101 made of resin and a lower casing 102 made of resin.

The upper casing 101 and the lower casing 102 are coupled by a plurality of supports 109 interposed between the upper casing 101 and the lower casing 102. An impeller 104 is rotatably housed inside the casing 103. The impeller 104 includes an annular main plate 105, an annular shroud 107, and a plurality of blades 106 disposed between the main plate 105 and the shroud 107, and the blades 106 are all backward blades having the same shape and are uniformly disposed in a circumferential direction.

The impeller 104 is obtained by filling a mold with resin and integrally forming, with the resin, the annular main plate 105, the annular shroud 107, and the plurality of blades 106 disposed in series in the circumferential direction between the main plate 105 and the shroud 107.

A suction port 108 is provided at the center of the upper casing 101. The impeller 104 rotating causes air to be sucked from the suction port 108. The sucked air passes through an opening formed in the shroud 107 and passes through between the blades 106 of the impeller 104, is blown off outward in a radial direction from the impeller 104, and is ejected toward the outside of the casing 103 from a blow-off port 110 formed in the side surface excluding the supports 109 interposed between the upper casing 101 and the lower casing 102.

In the impeller 104 of the centrifugal fan of JP 2019-203473 A, the annular main plate 105, the annular shroud 107, and the plurality of blades 106 are integrally formed by the resin. However, in a case where these are integrally formed by injection molding of resin, the structure of the mold becomes complicated. In order to facilitate the impeller manufacturing, as an example of manufacturing an impeller, it is known that an annular shroud and a plurality of blades are integrally formed by resin, and lower ends of the plurality of blades and an annular main plate are bonded by ultrasonic welding (for example, see JP 53-54301 A).

In a method for manufacturing a synthetic resin impeller disclosed in JP 53-54301 A, a plurality of blade portions 2 are integrally formed in a projecting manner on an inner side surface of a front shroud 1 (corresponding to the shroud 107 in JP 2019-203473 A) formed of a thermoplastic resin. Welding ridges 4 having a triangular cross section are each integrally formed on a side end surface of the blade portion 2 along a longitudinal direction of the blade portion 2. A plurality of welding grooves 5 are formed on an inner side surface of a rear shroud 3 (corresponding to the main plate 105 in JP 2019-203473 A) each corresponding to the welding ridge 4. Then, the tip of the welding ridge 4 is brought into contact with and pressed against a center portion of a bottom surface of the welding groove, and the side end surface of the blade portion 2 and the rear shroud 3 are integrally welded by ultrasonic welding.

SUMMARY

In the impeller 104 of the centrifugal fan described in JP 2019-203473 A, the annular main plate 105, the annular shroud 107, and the plurality of blades 106 are integrally formed by resin. However, such structure causes the mold to be complicated. Accordingly, it is conceivable to apply the method for manufacturing the impeller described in JP 53-54301 A to the impeller of the centrifugal fan described in JP 2019-203473 A.

In the method for manufacturing the impeller described in JP 53-54301 A, the plurality of blade portions 2 (corresponding to the blades 106 in JP 2019-203473 A) are integrally formed on the inner side surface of the front shroud 1 (corresponding to the shroud 107 in JP 2019-203473 A), and the welding ridges 4 are integrally formed on the end surfaces of the blade portions 2.

When the above-described member is produced by injection molding of resin using a mold, a uniform member is produced. However, weight unbalance may occur in the molded member due to variations in injection molding conditions. For this reason, the unbalance of the impeller is generally corrected by a balance correction machine. However, since the welding ridges 4 formed on the end surfaces of the blade portions 2 and the welding grooves 5 corresponding to the welding ridges 4 all have the same shapes, the welding ridges 4 and the welding grooves 5 corresponding to the welding ridges 4 can be freely combined and cannot be assembled at a fixed location. Because of this, the location where the unbalance occurs is not fixed, and therefore it is difficult to specify the cause of the unbalance. For example, in a case where the cause of the unbalance is wear of the injection mold, it is difficult to identify the location of the wear.

In view of the above-discussed circumstances, an object of the disclosure is to provide an impeller and a centrifugal fan capable of easily specifying a cause of weight unbalance of the impeller.

According to the disclosure, an impeller includes: a main plate having an annular shape; a shroud spaced apart from the main plate in an axial direction and having an annular shape; and a plurality of blades disposed in series in a circumferential direction between the main plate and the shroud. The blades are formed integral with the shroud and include ribs protruding in the axial direction on end surfaces of the blades in the axial direction. The main plate includes grooves to be fitted with the ribs. The shroud includes a mark. One set of a rib and a groove of the ribs and the grooves can be fitted each other. The one set of the rib and the groove and combinations of the ribs and the grooves other than the one set of the rib and the groove cannot be fitted each other.

The disclosure provides an impeller and a centrifugal fan capable of easily specifying a cause of weight unbalance of the impeller.

DESCRIPTION OF EMBODIMENTS

1. Configuration of Centrifugal Fan

Figure 1:
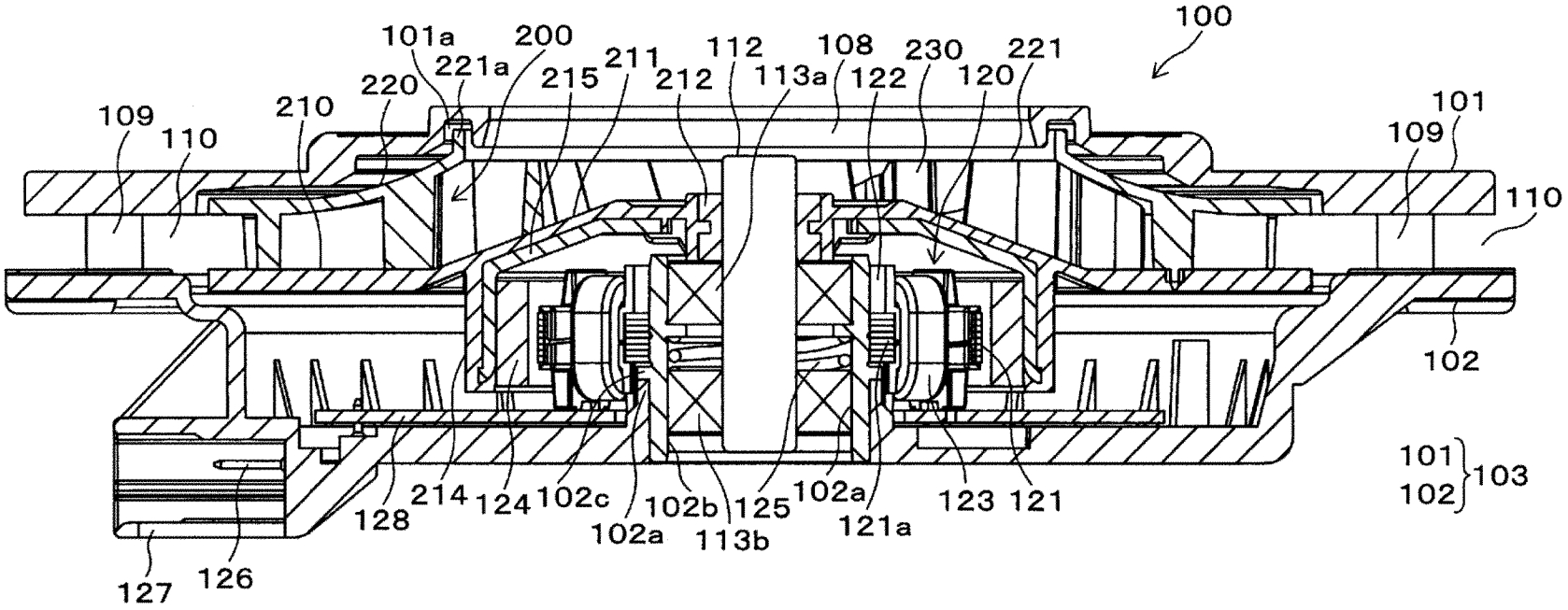
FIG. 1 is cross-sectional view of a centrifugal fan according to an embodiment of the disclosure.

FIG. 1 is a cross-sectional view of a centrifugal fan 100 according to an embodiment of the disclosure taken along a shaft 112. The centrifugal fan 100 includes a casing 103 composed of an upper casing 101 made of resin and a lower casing 102 made of resin. The casing 103 has a quadrangular shape (including a substantially square shape) in a plan view, but is not limited to the quadrangular shape and may have a circular shape.

The upper casing 101 and the lower casing 102 are coupled by supports 109 interposed between the upper casing 101 and the lower casing 102 in four corners of the upper and lower casings. The upper casing 101, the lower casing 102, and the supports 109 are formed by injection molding of resin. Specifically, a member made of the upper casing 101 and the supports 109 being integrated is formed by an injection molding method using resin as a raw material, while the lower casing 102 is separately formed by a similar injection molding method. The supports 109 may be formed separately from the upper casing 101 and may be coupled to the upper casing 101 using a fastening member such as a screw or a bolt.

The supports 109 are inserted into through holes formed in the lower casing 102 and tips of the supports 109 protruding from the through holes are thermally deformed (thermal caulking, infrared caulking, or the like) to form crushed tip portions, whereby the upper casing 101 and the lower casing 102 are coupled to each other via the supports 109. The upper casing 101 and the lower casing 102 can be coupled by using a fastening member such as a screw or a bolt.

An impeller 200 is rotatably housed inside the casing 103. The impeller 200 is made of resin, and includes a main plate 210 having an annular shape, a shroud 220 having an annular shape, and a plurality of blades 230 between the main plate 210 and the shroud 220. The blades 230 are all backward blades having the same shape, and are evenly disposed in a circumferential direction. The configuration of the impeller 200 will be described in detail later.

A suction port 108 formed of a circular opening is provided at the center of the upper casing 101. The impeller 200 rotating causes air to be sucked from the suction port 108. The sucked air passes through a circular opening formed in the shroud 220 and passes through between the blades 230 of the impeller 200, is blown off outward in a radial direction from the impeller 200, and is ejected toward the outside of the casing 103 from a blow-off port 110 formed over the entire circumference excluding the supports 109 interposed between the upper casing 101 and the lower casing 102.

A dish-shaped hub 211 having an opening portion at the center is formed in a central portion of the annular main plate 210 constituting the impeller 200, and in the opening portion at the center of the hub 211, a bush 212 made of metal is embedded and coupled integrally with the main plate 210. The shaft 112 made of metal is fixed to the bush 212 by a method such as press fitting or adhesion.

An annular projection 102*a* protruding in the axial direction is formed in a center portion of the lower casing 102, and a cylindrical bearing holder 102*b* made of metal is fixed to the annular projection 102*a*. A pair of ball bearings 113*a* and 113*b* is fixed to an inner periphery of the bearing holder 102*b*, and the shaft 112 is rotatably fixed to the ball bearings 113*a* and 113*b*. A coil spring 125 for applying pressure to the ball bearings 113*a* and 113*b* is interposed between the ball bearings 113*a* and 113*b*.

A cylindrical portion 214 extends downward from an end portion on an outer side in the radial direction of the hub 211. An annular rotor yoke 215 made of soft magnetism (iron material) is integrally formed as an insert material at the inner side of the hub 211 and the inner peripheral surface of the cylindrical portion 214, and an annular rotor magnet 124 is fixed to the inner peripheral surface of the rotor yoke 215 with an adhesive. The rotor magnet 124 is magnetized with the polarity of the magnetic pole alternately reversed to be N, S, N, S, and the like along the circumferential direction.

The impeller 200 is driven by a motor 120 and rotates. The motor 120 is a brushless DC motor of an outer rotor type. A stator of the motor 120 is fixed to an outer periphery of the bearing holder 102*b* fixed to the lower casing 103. The stator of the motor 120 is composed of a stator core 121, an insulator 122, and a stator coil 123.

The stator core 121 has a structure obtained by laminating a plurality of thin plates of soft magnetic material such as electromagnetic steel plates. The stator core 121 includes a plurality of pole teeth extending radially toward the outer side in the radial direction from a core back portion 121*a* having an annular shape. The insulator 122 made of resin is attached to the stator core 121, and the stator coil 123 is wound around the plurality of pole teeth via the insulator 122.

A projection part 102*c* formed in an annular shape protruding outward in the radial direction is formed on the outer peripheral surface of the bearing holder 102*b*. An opening of the core back portion 121*a* is fitted to the outer peripheral surface of the bearing holder 102*b*, and a lower end surface of the core back portion 121*a* is set on the projection part 102*c*, whereby the stator core 121 is positioned in the axial direction.

At a position facing the outer peripheral surface of the pole teeth of the stator core 121, the rotor magnet 124 is located with a gap from the outer peripheral surface of the pole teeth. By periodically switching the polarity of a current supplied to the stator coil 123 by a drive circuit (not illustrated), a driving force for rotating the rotor magnet 124 about the shaft 112 is generated, and the impeller 200 rotates.

A connector housing 127 including a connector pin 126 is integrally formed with the lower casing 102 at a lower part of the lower casing 102. The connector pin 126 is set in an injection mold (not illustrated) as an insert material, and the connector housing 127 is molded integrally with the lower casing 102 by injection molding of a thermoplastic resin. The connector pin 126 has, for example, an L shape, one end portion of the connector pin 126 protrudes into the connector housing 127, and the other end portion is inserted into a through hole formed in a circuit board 128 and is electrically connected to a wiring pattern by solder.

Electronic circuits and electronic components required for driving the motor 120 are mounted on the circuit board 128.

2. Configuration of Impeller

Figure 2:
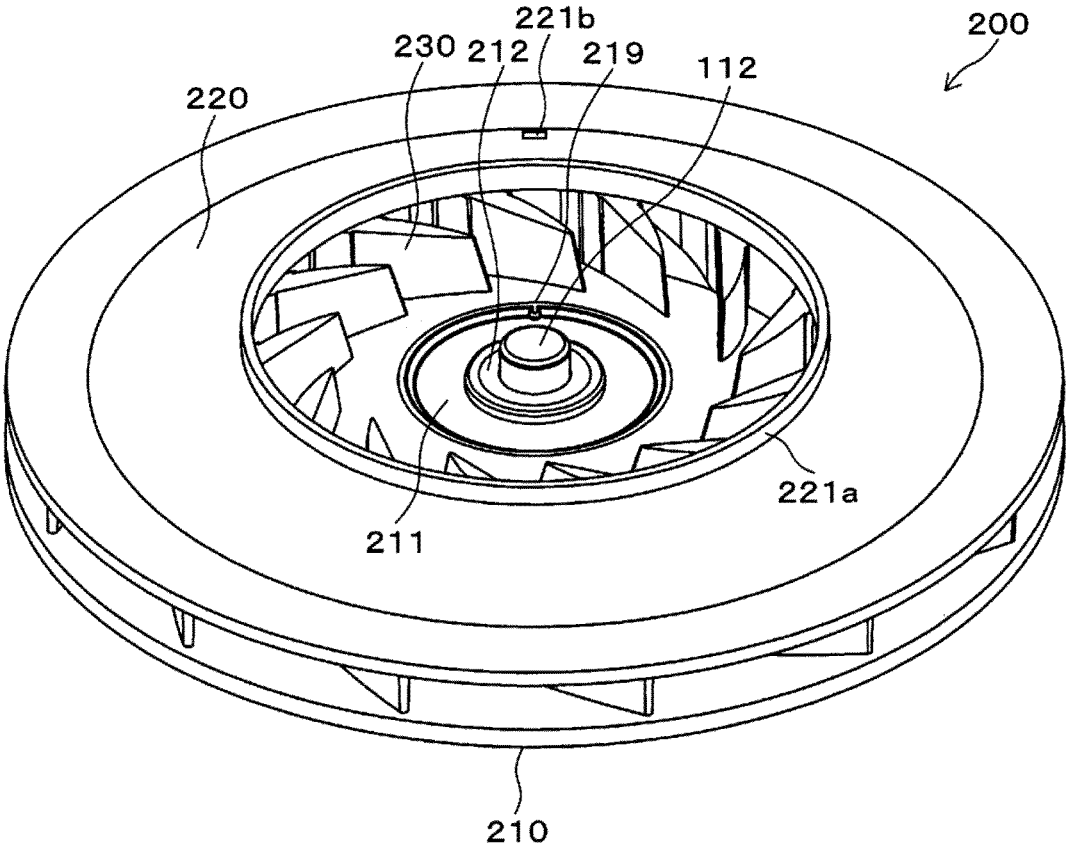
FIG. 2 is a perspective view illustrating an impeller according to the embodiment of the disclosure.
Figure 3:
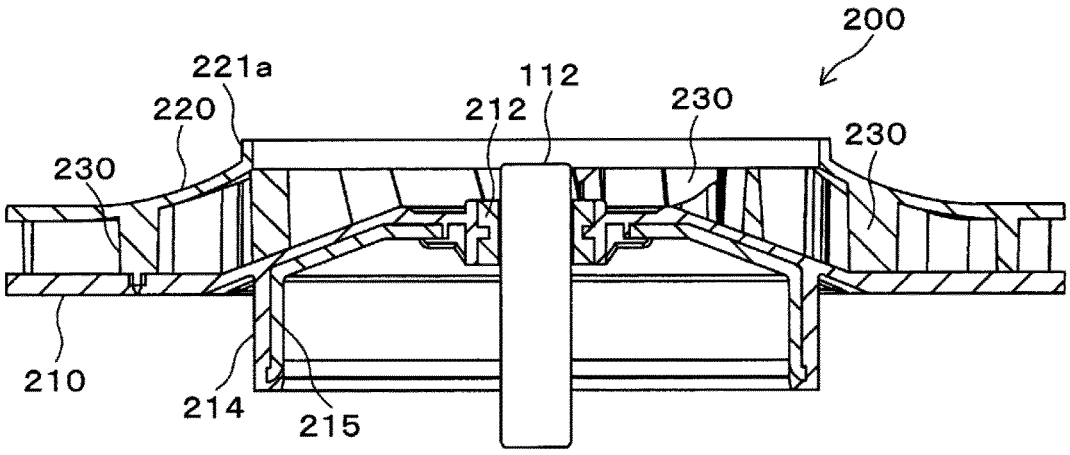
FIG. 3 is a cross-sectional view illustrating the impeller according to the embodiment of the disclosure.
Figure 4A:
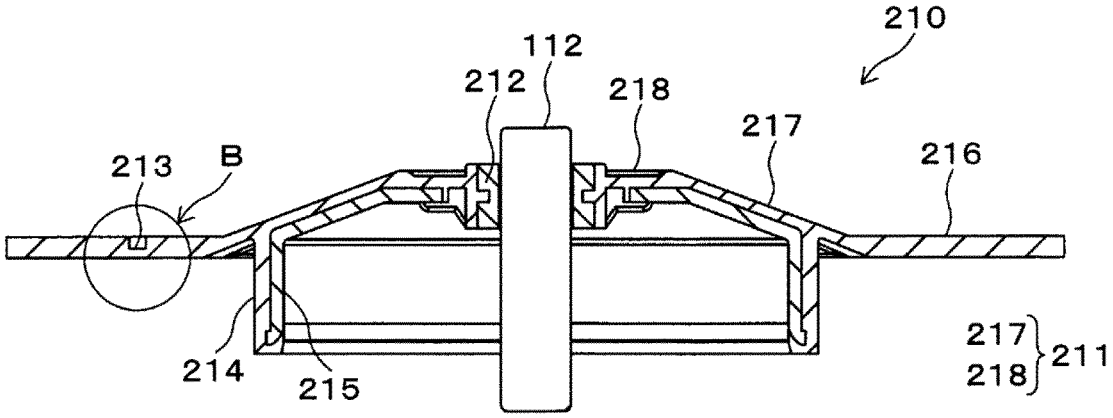
FIG. 4A is a cross-sectional view illustrating a main plate according to the embodiment of the disclosure.
Figure 4B:
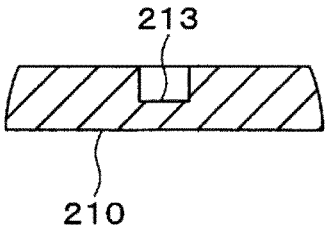
FIG. 4B is an enlarged view of a portion indicated by an arrow B in FIG. 4A.

The impeller 200 of the embodiment will be described with reference to FIGS. 2 to 7A and 7B. FIGS. 2 and 3 illustrate the overall configuration of the impeller 200, and FIGS. 4A and 4B illustrate the main plate 210. As illustrated in FIGS. 4A and 4B, the main plate 210 includes a first plane part 216 on an outer periphery side, an inclined part 217 on an inner side in the radial direction relative to the first plane part 216 and having an outer diameter gradually decreasing toward an axially upper side, and a second plane part 218 on an inner side relative to inclined part 217. The inclined part 217 and the second plane part 218 constitute the hub 211. The first and second plane parts 216 and 218 are orthogonal to the axial direction.

Figure 5:
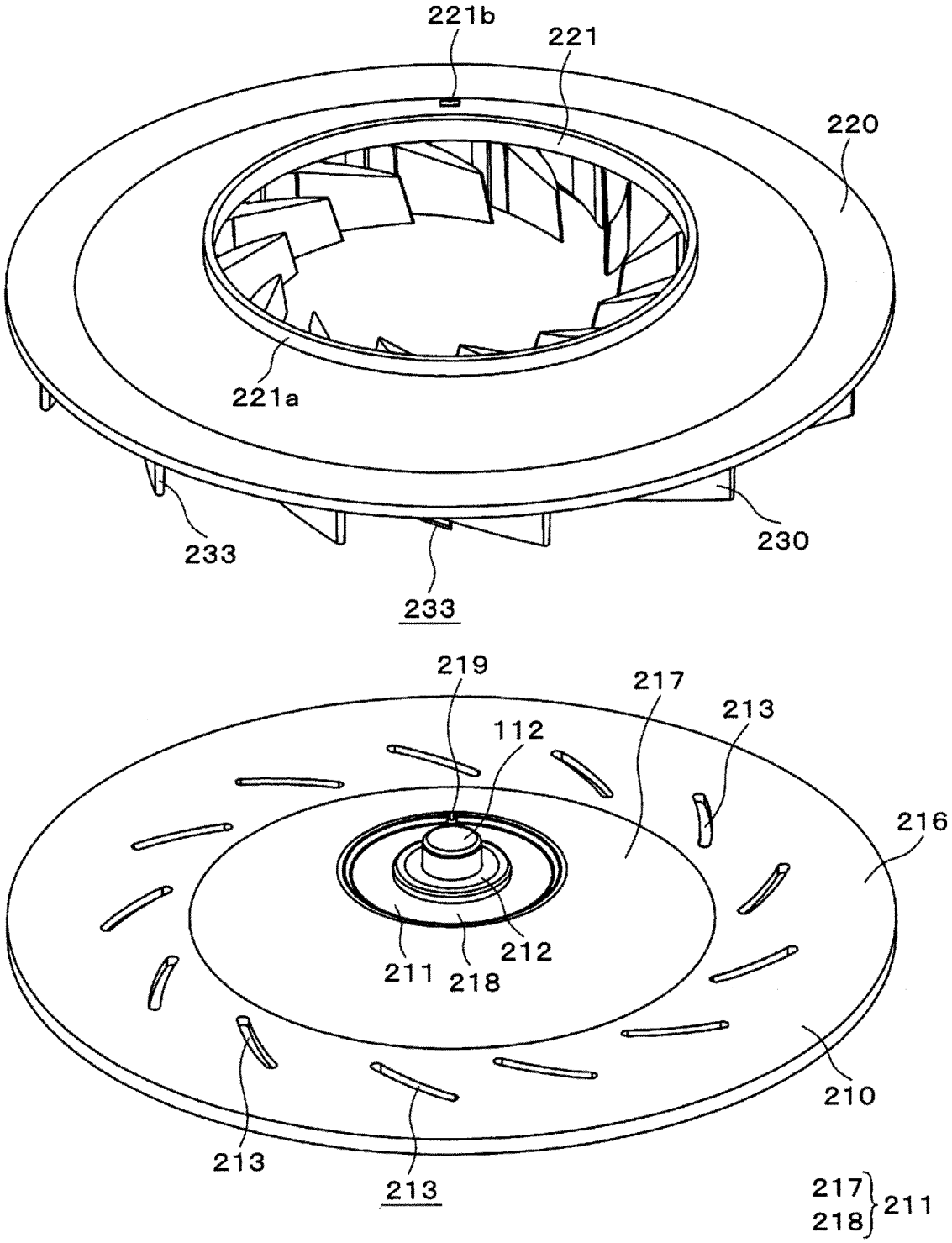
FIG. 5 is an exploded perspective view illustrating the impeller according to the embodiment of the disclosure.
Figure 6:
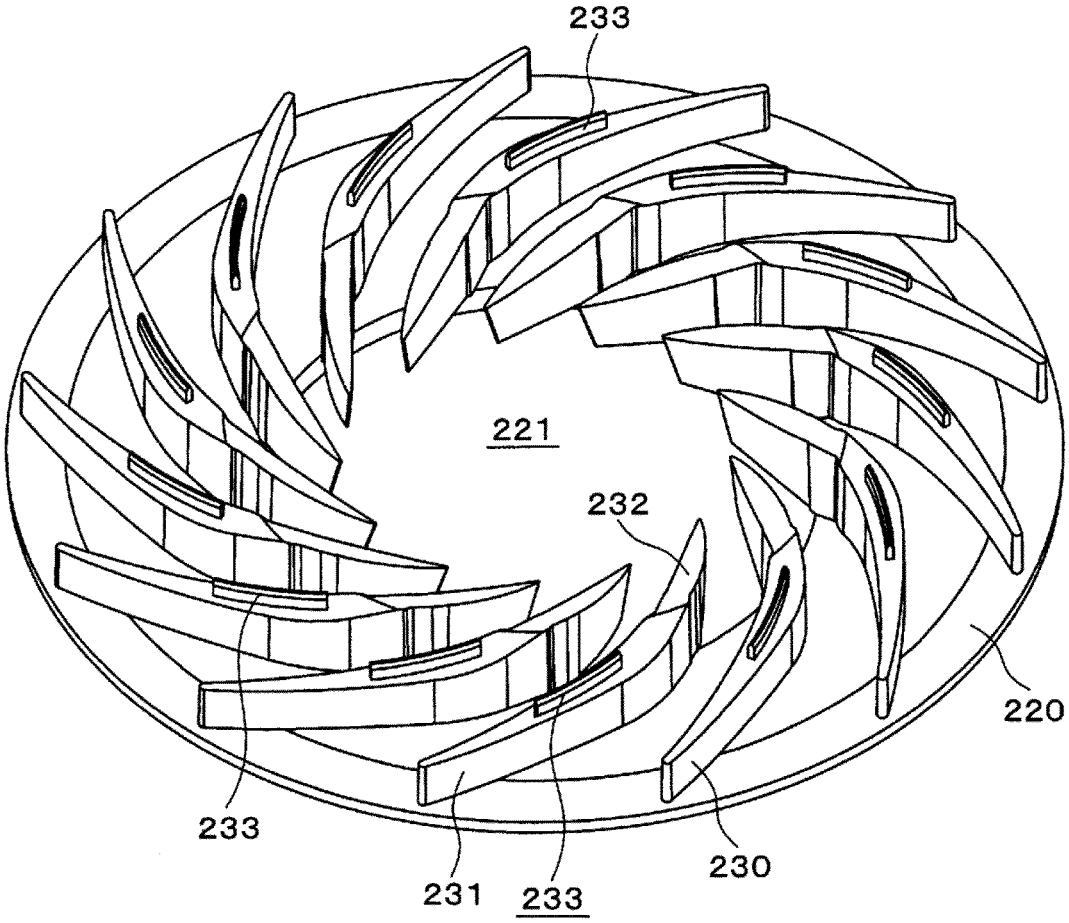
FIG. 6 is a perspective view of a shroud according to the embodiment of the disclosure as viewed from rear.

FIG. 6 is a perspective view of the shroud 220 as viewed from rear. The shroud 220 includes an opening portion 221 having a circular shape, and the opening portion 221 is located at an outer periphery side of the suction port 108 of the impeller 200 and functions as a suction port for guiding air to the impeller 200. As illustrated in FIG. 5, an annular projection part 221*a* extending in the axial direction is formed on a peripheral edge of the opening portion 221. On the other hand, in the upper casing 101, as illustrated in FIG. 1, a peripheral edge portion of the suction port 108 constitutes a bell-mouth portion, and an annular groove 101*a* is formed at an outer periphery side of the bell-mouth portion. The projection part 221*a* of the shroud 220 is disposed in the groove 101*a*, and a slight gap is formed between the groove 101*a* and the projection part 221*a*, thereby forming a labyrinth seal.

The plurality of blades 230 are formed on the shroud 220 at equal intervals in the circumferential direction. The blades 230 are formed integrally with the shroud 220 by injection molding of a thermoplastic resin. The blade 230 has a substantially arc shape in a plan view, and an outer peripheral side portion 231 on the outer side in the radial direction is integrated with the shroud 220. An inner peripheral side portion 232 on the inner side in the radial direction of the blade 230 protrudes toward the opening portion 221 side and is formed as an acute edge. The blade 230 constitutes a backward blade. An arc-shaped protruding portion of the backward blade faces to the rotation direction.

Figure 7A:
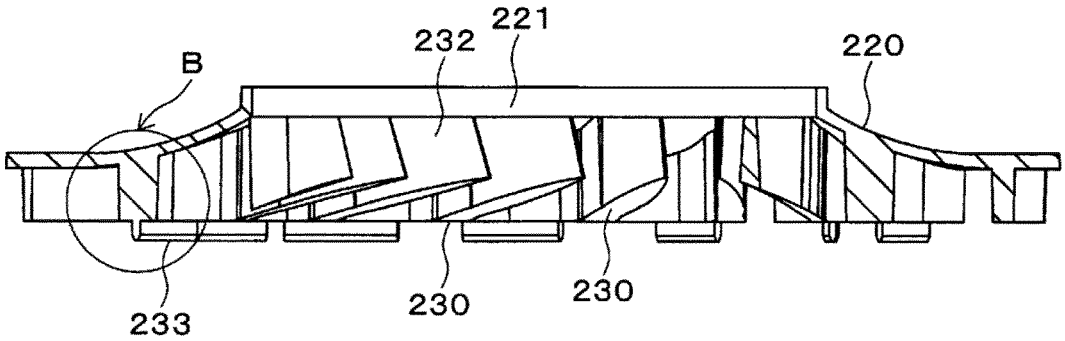
FIG. 7A is a cross-sectional view illustrating the shroud according to the embodiment of the disclosure.
Figure 7B:
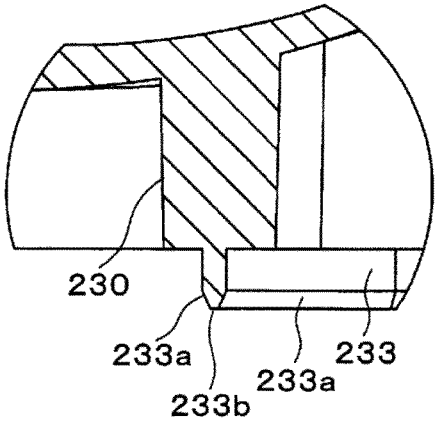
FIG. 7B is an enlarged view of a portion indicated by an arrow B in FIG. 7A.

As illustrated in FIGS. 7A and 7B, the inner peripheral side portion 232 of the blade 230 has a substantially trapezoidal shape in a side view and is inclined upward in the axial direction. As a result, a lower surface of the inner peripheral side portion 232 comes into contact with the inclined surface 217 of the main plate 210. An upper surface of the inner peripheral side portion 232 is aligned to be flush with each other in the opening portion 221 of the shroud 220.

A rib 233 protruding in the axial direction is formed on an intermediate portion located between the outer peripheral side portion 231 and the inner peripheral side portion 232. The intermediate portion is a surface on the opposite side to the shroud 220 of the blade 230. All of the ribs 233, except one rib, have the same shape and size, and are formed at predetermined positions. In FIG. 6, the rib denoted by a reference sign 233 has the same shape and size as the other ribs 233, but the position is shifted in the radial direction.

On the other hand, on the first plane part 216 of the main plate 210, grooves 213 all having the same shape and size, except one groove, are formed at equal intervals in the circumferential direction. The groove denoted by a reference sign 213 in FIG. 5 has the same shape and size as the other grooves 213 but is located at a position different from the positions of the other grooves 213 and corresponding to the rib 233 shifted in the radial direction. The rib 233 is fitted into the groove 213, but the other ribs 233 cannot be fitted into this groove. Therefore, when the rib 233 is fitted into the groove 213 and the ribs 233 are fitted into the other grooves 213, the relative positions of the main plate 210 and the shroud 220 are always the same. As illustrated in FIG. 5, a protruding part (second mark) 219 protruding in the axial direction is formed in the vicinity of the inclined part 217 of the second plane part 218 at a 180° opposite side of the groove 213.

As illustrated in FIG. 7B, inclined surfaces 233*a* are formed on both sides of the lower end portion of the rib 233. Lower edges of the inclined surfaces 233*a* are connected to each other at a flat surface 233*b*. The height of the rib 233 is greater than the depth of the groove 213. The width of the rib 233 is smaller than the width of the groove 213.

As illustrated in FIG. 5, a recessed part (mark) 221 *b* is formed at a 180° opposite side of the rib 233 on the upper surface of the shroud 220. When the shroud 220 formed with the ribs 233 is assembled to the main plate 210, the positions of the recessed part 221*b* and the protruding part 219 in the hub 211 are matched to adjust the positions of the main plate 210 and the shroud 220. As a result, the groove 213 and the rib 233 are always located at a 180° opposite side of the recessed part 221*b*. At the same time as the rib 233 is inserted into the groove 213, the other ribs 233 are inserted into the other grooves 213.

After the shroud 220 including the blades 230 is assembled to the main plate 210, the end portions of the ribs 233 contacting the bottom surfaces of the grooves 213 are subjected to ultrasonic melting. With this, the melted material of the end portion of each rib 233 flows into the gap between the groove 213 and the rib 233, and the rib 233 is welded in the groove 213. As a result, a portion of the blade 230 excluding the inner peripheral side portion 232 abuts against the bottom surface of the main plate 210, and the inner peripheral side portion 232 of the blade 230 abuts against the inclined part 217 of the main plate 210.

3. Effect

Balance adjustment is performed on the completed impeller 200. The impeller 200 is mounted on a balance adjuster and is rotated. In this case, the recessed part 221*b* is used to measure the rotation speed of the impeller 200. When unbalance of the impeller 200 is detected by the balance adjuster and a portion causing the unbalance is specified, the balance adjuster adjusts the balance by, for example, cutting the portion causing the unbalance. In a case where the portion causing the unbalance is the same portion every time, for example, when the portion causing the unbalance is always thick, the injection mold may be worn.

In the impeller 200 of the above-described embodiment, relative positions of the main plate 210 and the shroud 220 are always the same, and thus the portion causing the unbalance can be grasped as a relative position with respect to the recessed part 221*b*. Accordingly, investigating a portion of the mold corresponding to the portion causing the unbalance allows the cause of the unbalance such as wear to be confirmed.

In particular, in the above-described embodiment, combinations of the ribs 233 and the grooves 213 other than one set of the rib 233 and the groove 213 are disposed at equal intervals in the circumferential direction, and the one set of the rib 233 and the groove 213 is disposed shifted in the radial direction from the positions at the equal intervals. Therefore, for example, when the blade 230 has a thin thickness of several millimeters, the rib 233 thinner than the blade 230 may have the same shape and strength as the other ribs 233.

In the above-described embodiment, since the protruding part 219 is provided in the hub 211 at the 180° opposite side of the one set of the rib 233 and the groove 213, the one set of the rib 233 and the groove 213 can be easily fitted to each other by causing the protruding part 219 to match the recessed part 221*b*. Since all of the blades 230 have the same shape and size and are disposed at equal intervals in the circumferential direction, there is no hindrance to the air-blowing function.

4. Modification Examples

The disclosure is not limited to the embodiment described above, and it is possible to make various modifications as described below.

i) It is also possible to adopt such a configuration that the ribs 233 and the grooves 213 other than one set of the rib 233 and the groove 213 are disposed at equal intervals in the circumferential direction, and the one set of the rib 233 and the groove 213 is shifted in the circumferential direction.

ii) It is also possible to adopt such a configuration that the ribs 233 and the grooves 213 are disposed at equal intervals in the circumferential direction, and one set of the rib 233 and the groove 213 has a different orientation from the orientation of the other sets of the ribs 233 and the grooves 213 at the positions at the equal intervals.

iii) It is also possible to adopt such a configuration that the ribs 233 and 233 and the grooves 213 and 213 are disposed at equal intervals in the circumferential direction, and one set of the rib 233 and the groove 213 has a smaller shape than the other ribs 233 and the other grooves 213 in a plan view.

iv) It is also possible to adopt such a configuration that the ribs 233 and 233 and the grooves 213 and 213 are disposed at equal intervals in the circumferential direction, and one set of the rib 233 and the groove 213 has a different shape from the other ribs 233 and the other grooves 213 in a plan view. For example, the one set of the rib 233 and the groove 213 has a shape including a bulge at a center portion in the longitudinal direction.

v) The mark may be a protruding part, a groove, a painted marking, a seal, or a cutout formed in the peripheral edge portion of the shroud 220 instead of the recessed part 221*b*.

The disclosure can be used for a centrifugal fan used for air blowing, ventilation, cooling, and the like in home appliances, office automation equipment, and air conditioners for industrial use and vehicles.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. An impeller, comprising:

a main plate having an annular shape;

a shroud spaced apart from the main plate in an axial direction and having an annular shape; and a plurality of blades disposed in series in a circumferential direction between the main plate and the shroud, wherein the blades are formed integral with the shroud and include ribs protruding in the axial direction on end surfaces of the blades in the axial direction, the main plate includes grooves to be fitted with the ribs, the shroud includes a first mark, one set of a rib and a groove of the ribs and the grooves can be fitted each other, and the one set of the rib and the groove and combinations of the ribs and the grooves other than the one set of the rib and the groove cannot be fitted each other.

2. The impeller according to claim 1, wherein the combinations of the ribs and the grooves other than the one set of the rib and the groove are disposed at equal intervals in the circumferential direction, and the one set of the rib and the groove is disposed shifted from positions at the equal intervals.

3. The impeller according to claim 2, wherein the one set of the rib and the groove is disposed shifted in a radial direction from the positions at the equal intervals.

4. The impeller according to claim 1, wherein the ribs and the grooves are disposed at equal intervals in the circumferential direction, and the one set of the rib and the groove has a different orientation from orientations of another sets of the ribs and the grooves at the positions at the equal intervals.

5. The impeller according to claim 1, wherein the ribs and the grooves are disposed at equal intervals in the circumferential direction, and the one set of the rib and the groove has a smaller shape than another ribs and grooves in a plan view.

6. The impeller according to claim 1, wherein the ribs and the grooves are disposed at equal intervals in the circumferential direction, and the one set of the rib and the groove has a different shape from another ribs and grooves in a plan view.

7. The impeller according to claim 1, wherein the mark is selected from among a recessed part, a protruding part, a cutout, a groove, a coating, and a seal.

8. The impeller according to claim 1, wherein the mark is provided at a 180° opposite side of the one set of the rib and the groove.

9. The impeller according to claim 1, wherein the blade has an arc shape protruding toward a rotation direction of the blade, and the ribs have an arc shape along the shape of the blade.

10. The impeller according to claim 1, wherein a second mark is provided at a portion visible from outside of the main plate.

11. The impeller according to claim 10, wherein a position of the second mark is substantially identical to a position of the first mark in the circumferential direction.

12. A centrifugal fan, comprising:

a casing, a motor; and the impeller of claim 1 fixed to an output shaft of the motor.

* * * * *